United States Patent [19]

Deutsch

[11] 4,398,442

[45] Aug. 16, 1983

[54] AUTOMATIC ADAPTIVE SELECTION OF ACCOMPANIMENT TONE CONTROLS FOR AN ELECTRONIC MUSICAL INSTRUMENT

[75] Inventor: Ralph Deutsch, Sherman Oaks, Calif.

[73] Assignee: Kawai Musical Instrument Mfg. Co., Ltd., Hamamatsu, Japan

[21] Appl. No.: 352,973

[22] Filed: Feb. 26, 1982

[51] Int. Cl.[3] ..... G10H 1/08; G10H 1/36; G10H 7/00

[52] U.S. Cl. ..... 84/1.17; 84/1.01; 84/1.03; 84/1.23

[58] Field of Search ..... 84/1.01, 1.03, 1.17, 84/1.22, 1.23, 1.24, DIG. 12, DIG. 22

[56] References Cited

U.S. PATENT DOCUMENTS

| | | | |
|---|---|---|---|
| 4,282,786 | 8/1981 | Deutsch et al. | 84/1.01 |
| 4,336,735 | 6/1982 | Amano et al. | 84/1.17 |
| 4,368,658 | 1/1983 | Deutsch et al. | 84/1.03 |

*Primary Examiner*—Stanley J. Witkowski
*Attorney, Agent, or Firm*—Ralph Deutsch

[57] ABSTRACT

In a musical instrument having a solo and accompaniment keyboard apparatus is provided whereby an accompaniment tone color is selected which adaptively complements selected solo tones. The first zero crossing spacing of the autocorrelation function for the solo tone is used to implement a tone selection logic. An effective zero crossing is computed for combinations of available accompaniment tones. An accompaniment tone combination is selected whose effective zero crossing has a maximum value that does not exceed a complemented value of the zero crossing for the selected solo tone.

9 Claims, 9 Drawing Figures

AUTOMATIC ADAPTIVE SELECTION OF ACCOMPANIMENT TONE CONTROLS FOR AN ELECTRONIC MUSICAL INSTRUMENT

BACKGROUND OF THE INVENTION

1. Field of the Invention

This invention relates to electronic tone synthesis and in particular is concerned with selecting a subset of a set of accompaniment tones which will complement preselected solo tones generated by an electronic musical instrument.

2. Description of the Prior Art

An electronic keyboard musical instrument, such as an electronic organ, is usually implemented with a number of tone switches for selecting the tones produced in response to actuated keyswitches. The tone switches are generally organized in groups which correspond to the tiers of keyboards each of which is composed of a linear array of keyswitches. Before starting to play such an instrument, the musician must confront the problem of selecting the combination of tone switches to be actuated for each of the keyboards. Since even a medium size instrument may contain about 10 tone switches per keyboard, the theoretical number of combinations of tone switches for a single keyboard is $2^{10}-1=1023$. Obviously, theoretically the musician is faced with a very large number of choices. Certain considerations, largely based upon a degree of musical maturity, are used in practice to greatly reduce the number of tone stop combinations which are eligible candidates to be selected. However, even the application of emperical tone selection rules still leaves a large number of residual switch selection choices.

Organs designed primarily for the performance of popular music are called by the generic name of "entertainment" organs. These instruments are usually designed to use solo type voices on the upper keyboard (also called the solo keyboard) and accompaniment type voices are available on the lower (also called the accompaniment keyboard) and pedal keyboards. A common tonal selection employed by the musician is to imitate a small combo group by selecting a solo stop for the upper keyboard along with a blending, or complementary, tone color for the lower keyboard and a similar blending tone for the pedal keyboard.

The choice of an accompaniment tone is, of course, ideally dependent upon the choice that has been made for the solo tones. Based upon years of experience with a wide variety of musical effects, some emperical rules have been formulated for the selection of accompaniment tones which complement specific solo tones. These rules are predicated upon a classification of organ tones. Before the rather recent advent of the tone synthesizer having time varying frequency domain sliding formant filters, organ tones were traditionally categorized as belonging to one of four tone classes. These classes comprised flutes, diapasons, strings, and reeds. These tone families are not sharply defined and in many border-line cases the classification of a tone type is somewhat subjective. A close examination of elements of these tone classes indicates that the classes differ primarily in the number of prominent harmonics as well as with the rate at which the harmonic levels decrease with an increase in the harmonic number.

Most of the emperical tone selection rules usually consist of instructions for selecting a tone from a given tone family for the accompaniment tone to complement a solo tone which has been selected from one of the tone classes. While these selection rules are not intended as firm regimens, they at least provide a certain degree of guidance for a novice musician who is faced with the tone section problem.

A means for generating an accompaniment tone color which complements a preselected solo tone color is described in the copending patent application Ser. No. 06/344,093 filed Jan. 20, 1982 entitled "Adaptive Accompaniment Tone Color For An Electronic Musical Instrument." The referenced application and the present invention have a common assignee. In the copending application apparatus is described for generating an accompaniment tone color by analyzing the selected tone musical waveshape and then performing a synthesis computation. The accompaniment tone color is not selected from a preselected library of waveshape data.

SUMMARY OF THE INVENTION

In a Polyphonic Tone Synthesizer of the type described in U.S. Pat. No. 4,085,644 a computation cycle and a data transfer cycle are repetitively and independently implemented to provide data which are converted to musical waveshapes. A sequence of computation cycles is implemented which comprises a solo tone computation cycle and an accompaniment tone computation cycle. During a solo computation cycle, a solo master data is created by implementing a discrete Fourier transform using a set of harmonic coefficients which characterize the selected output solo musical sounds. During an accompaniment tone computation cycle, an autocorrelation function is computed corresponding to the selected solo tone. A complementary zero crossing value is computed from the measured correlation spacing corresponding to the first zero crossing of the computed autocorrelation function. Each of the sets of harmonic coefficients comprising the library of available accompaniment tone colors contains an accompaniment zero crossing value. Logic is implemented whereby a combination of accompaniment stops is selected corresponding to their resultant autocorrelation function zero crossing value. The selected combination of stops is selected by a closeness criterion between the resultant autocorrelation function zero crossing value and the computed complementary zero crossing value. The selected combination of accompaniment stops varies to adapt to changes made in the solo musical sounds.

After the combination of accompaniment stops has been selected an accompaniment master data set is computed and stored in an accompaniment register. All the calculations are carried out at a fast rate which may be nonsynchronous with any musical frequency.

Following a complete computation cycle, a transfer cycle is initiated during which the stored solo master data set is transferred to preselected members of a multiplicity of solo tone generators and the stored accompaniment master data set is transferred to preselected members of a multiplicity of accompaniment tone generators. The output tone generation of the musical instrument continues uninterrupted during the computation and transfer cycles. The transferred data are stored in a note register contained in each of the tone generators. The master data set stored in the note registers of the preselected members of the multiplicity of tone generators is sequentially and repetitively read out of storage and converted to an analog musical waveshape by means of a digital-to-analog converter. The memory addressing rate is proportional to the corresponding fundamental frequency of the musical pitch associated with a tone generator.

It is an object of the present invention to select a combination of accompaniment tones from a library of accompaniment tones which is the closest combination which complements a selected solo tone.

DESCRIPTION OF THE DRAWINGS

The detailed description of the invention is made with reference to the accompanying drawings wherein like numerals designate like components in the figures.

DETAILED DESCRIPTION OF THE INVENTION

The present invention is directed to a subsystem for selecting a combination of accompaniment musical tones, from a library of accompaniment musical tones, which adaptively complement a preselected solo tone combination and which is incorporated into a musical tone generator of the type which synthesizes musical waveshapes by implementing a discrete Fourier transform algorithm. A tone generation system of this type is described in detail in U.S. Pat. No. 4,085,644 entitled "Polyphonic Tone Synthesizer" which is hereby incorporated by reference. In the following description all the elements of the system which are described in the reference patent are identified by two digit numbers which correspond to the same numbered elements appearing in the referenced patent. All system element blocks which are identified by three digit numbers correspond to system elements added to the Polyphonic Tone Synthesizer to implement the improvements of the present invention to produce an adaptive accompaniment tone selection in response to preselected solo musical tones.

A feature of the present invention is a means for categorizing preselected solo tones by means of the autocorrelation functions corresponding to the solo tone waveforms. For a periodic waveshape, such as that produced by a tone generator in the system described in U.S. Pat. No. 4,085,644, the amplitude signal can be expressed by the real part of the complex relation $$x(t) = \sum_{n=-N}^{N} a_n \exp(i2\pi nt/T) \qquad \text{Eq. 1}$$

The corresponding autocorrelation function is defined by the following displaced function average over a period $$R(\tau) = 1/T \int_{-T/2}^{T/2} x(t+\tau)x^*(t)dt \qquad \text{Eq. 2}$$

Eq. 1 and Eq. 2 can be combined to produce $$R(\tau) = \sum_{n=0}^{N} a_n^2 \cos(\pi n\tau/N) \qquad \text{Eq. 3}$$

It is noted that the autocorrelation function corresponding to a periodic function is also a periodic function of the same period as the original waveshape x(t). The shape of the autocorrelation function is not the same as that of the original time series, or signal, x(t). This change is apparent because the harmonic coefficient in Eq. 1 can have both positive and negative values while only the positive values of $a_n^2$ appear in Eq. 3.

Figure 1:
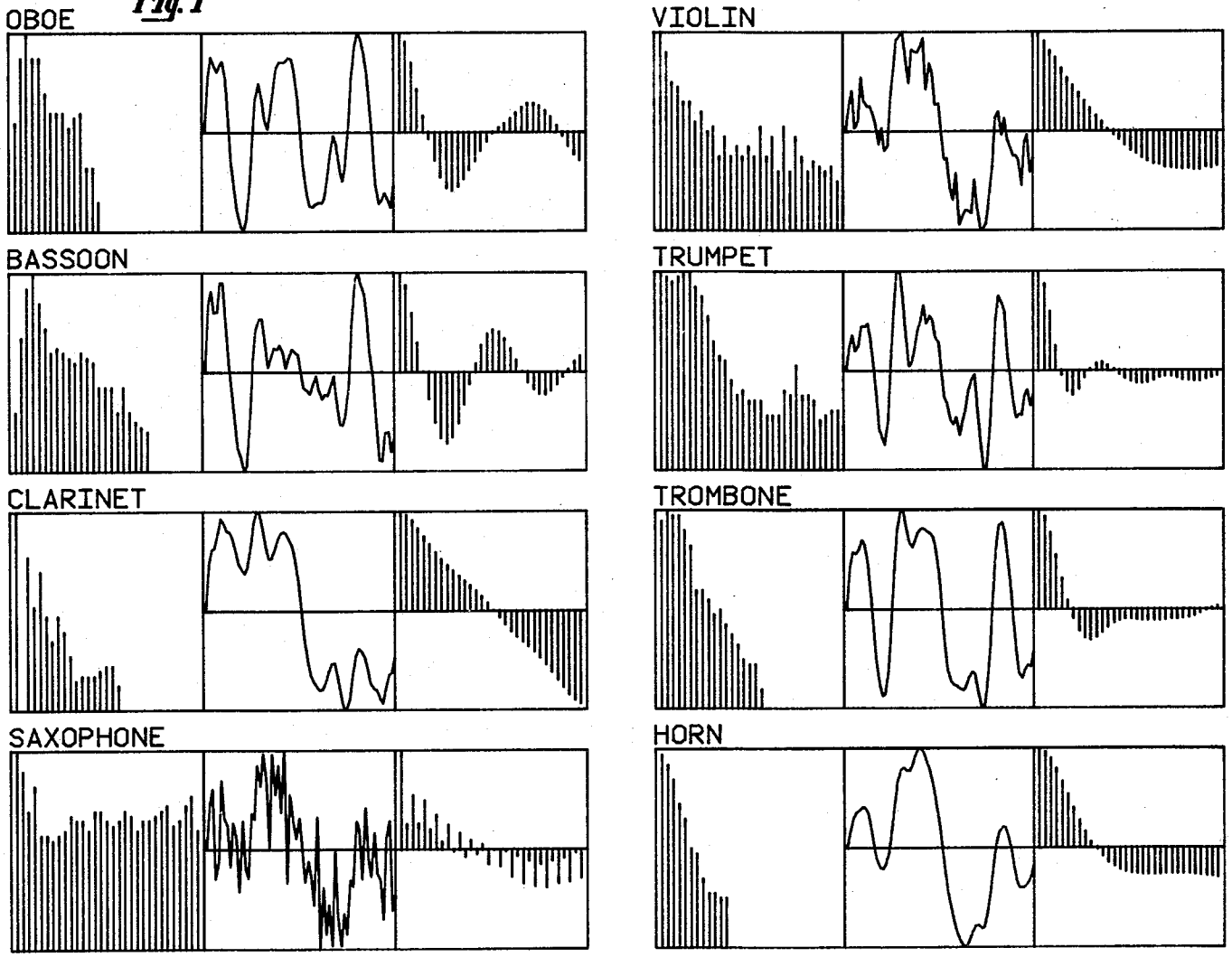
FIG. 1 is a set of musical waveforms and their corresponding autocorrelation functions.

FIG. 1 illustrates some typical periodic musical waveshapes and their corresponding autocorrelation functions. In each case the left section is the set of 32 harmonic coefficients drawn in the range of 0–40 db. The middle section is the waveshape for one period of the musical signal. The right section is the autocorrelation function plotted for a normalized range of +1 to −1. An examination of FIG. 1 indicates that the autocorrelation functions are approximately of the well-known sin x/x functional shape. Moreover the first zero of the autocorrelation function is a measure of the width of the corresponding tone spectra. A wide spectral width produces a small value of the autocorrelation displacement parameter $\tau$ for the first zero crossing. Conversely, a narrow spectral width produces a larger value of $\tau$ for the first zero crossing of the autocorrelation function.

It is noted that the autocorrelation function is related to the autocovariance function used in mathematical statistics. If the waveshape has a zero mean (average) value then the autocorrelation function is equivalent to the autocovariance function except for a normalizing constant. The waveshapes generated by the Polyphonic Tone Synthesizer described in the referenced U.S. Pat. No. 4,085,644 are generated to have a zero mean value.

Figure 2:
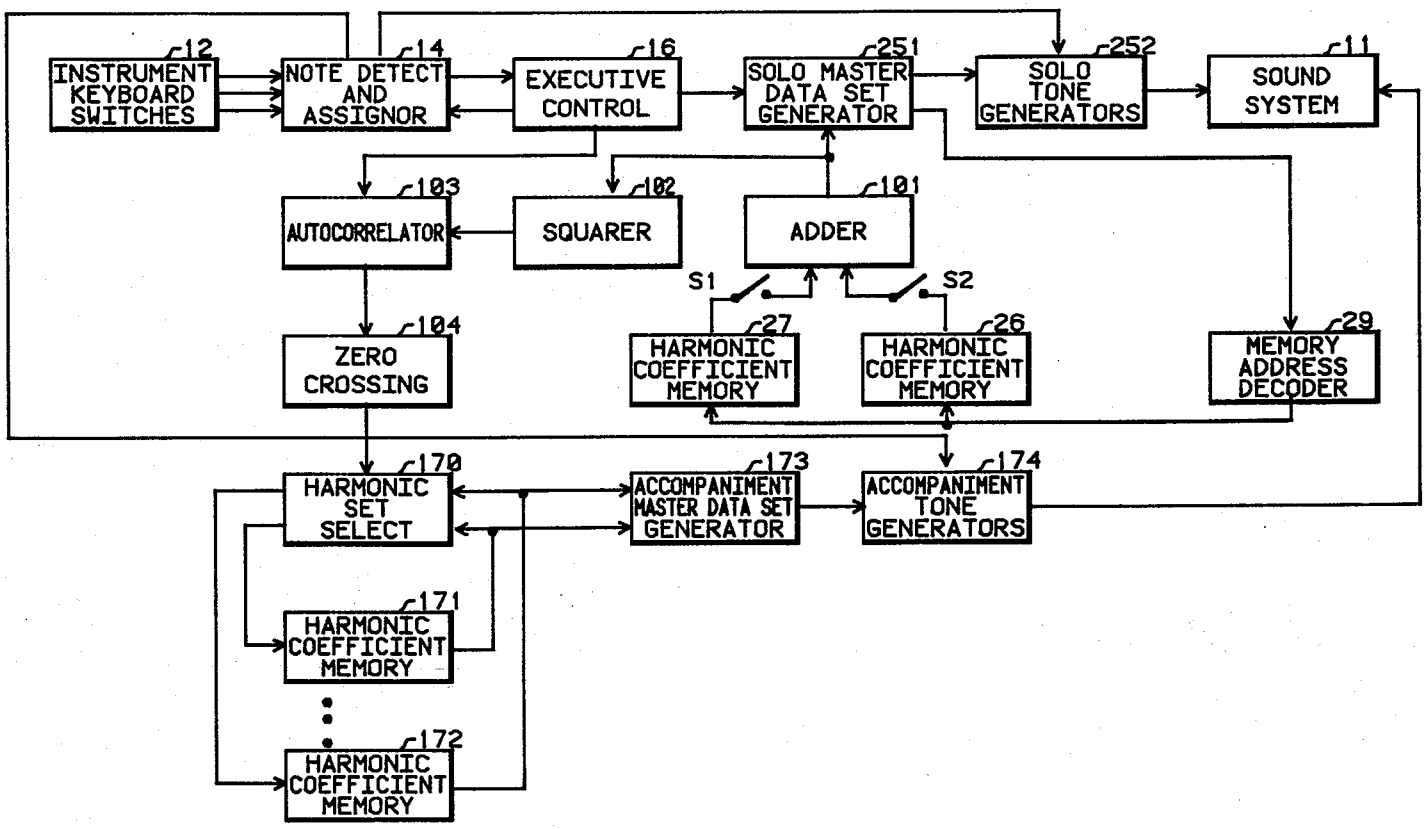
FIG. 2 is a schematic diagram of an embodiment of the invention.

FIG. 2 shows an embodiment of the present invention which is described as a modification and adjunct to the system described in U.S. Pat. No. 4,085,644. As described in the referenced patent, the Polyphonic Tone Synthesizer includes an array of keyboard switches. These are contained in the block labeled instrument keyboard switches 12 which, for example, correspond to the conventional keyboard linear array of switches for an electronic musical instrument such as an organ. If one or more keys are actuated ("on" switch position) on the instrument's keyboard, the note detect and assignor circuit 14 stores the corresponding note information for the actuated keyswitches and assigns one member of a set of twelve tone generators to each actuated keyswitch. The tone generators are divided into two groups. One group of tone generators is used to generate the solo tones corresponding to keyswitches actuated on the solo, or upper, keyboard. This group of tone generators is contained in the block labeled solo tone generators 252. The second group, contained in the block labeled accompaniment tone generators 174, is used to generate the accompaniment tones corresponding to the keyswitches actuated in the accompaniment (lower) keyboard. A suitable note detect and assignor subsystem is described in U.S. Pat. No. 4,022,098 which is hereby incorporated by reference.

When one or more keyswitches on the keyboards has been actuated, the executive control 16 initiates a computation cycle consisting of two subcycles. During the first subcycle of the computation cycle, a solo master data set consisting of 64 data words is computed by means of the solo master data set generator 151 in a manner described in the referenced U.S. Pat. No. 4,085,644. The solo master data set is stored in a solo master data set memory which is contained in the solo master data set generator 251. The 64 data words are generated using harmonic coefficients selected by the combination of switches S1 and S2 from data values addressed out from the harmonic coefficient memories 26 and 27 in response to addresses furnished by the memory address decoder 29. The selected harmonic components are summed by the adder 101 and the summed values are provided to the solo master data set generator 251. The 64 data words correspond to the amplitudes of 64 equally spaced points for one cycle of the audio waveform for the musical tone produced by the selected tone generators in the solo tone generators 252. The general rule is that the maximum number of harmonics in the audio tone spectra is no more than one-half of the number of data points in one complete waveshape cycle, or equivalently the number of data points comprising the master data set.

At the completion of the computation cycle, a transfer cycle is initiated during which the solo master data set stored in the solo master data set memory is transferred to note registers which are elements of each member of the set of tone generators contained in the solo tone generators 252. These note registers store 64 data words which correspond to one complete cycle of a preselected musical tone. The data words stored in the note registers are read out sequentially and repetitively and transferred to a digital-to-analog converter which converts the digital data words into an analog musical waveshape. The musical waveshape is transformed into audible sound by means of the sound system 11 consisting of a conventional amplifier and speaker subsystem. The stored data is read out of each note register at a rate corresponding to the fundamental frequency of the note corresponding to the actuated keyswitch to which a tone generator has been assigned.

As described in the referenced U.S. Pat. No. 4,085,644, it is desirable to be able to continuously recompute and store the generated master data sets during a sequence of computation cycles and to load this data into the note registers while the actuated keys remain depressed on the keyboards. This system function is accomplished without interrupting the flow of data points to the digital-to-analog converter at the read-out clock rates.

During the second subcycle of the computation cycle, in a manner described below, an accompaniment master data set is computed and stored in an accompaniment master data set memory contained within the accompaniment master data set generator 173. The 64 data words comprising this master data set are generated by selecting members of a library of accompaniment harmonic coefficients in response to the first zero crossing of the autocorrelation function of the selected solo tones. At the completion of the second subcycle of the computation cycle, a transfer cycle is initiated during which the accompaniment master data set stored in the accompaniment master data set memory is transferred to note registers which are elements of each member of the set of tone generators contained in the accompaniment tone generators 174. The data words stored in these note registers are transformed into audible sounds in the same manner as previously described for the solo tone generators.

The summed values of the selected solo harmonic coefficients from the output of the adder 101 are squared in magnitude by means of the squarer 102 which multiplies each input data value by itself. The output data from the squarer 102 is used by the autocorrelator 103 to compute the autocorrelation function corresponding to the selected harmonic coefficients for the solo tones.

Autocorrelator 103 computes the autocorrelation function and the zero crossing 104 finds the location of the first zero crossing of the autocorrelation function. In response to the detected location of the first zero crossing of the autocorrelation function, harmonic set select 170 determines a combination of harmonic coefficients stored in the harmonic coefficient memories 171–172 which in combination will produce a tone having an autocorrelation function which will complement that corresponding to the selected solo tone. While only two accompaniment harmonic coefficient memories are shown explicitly in FIG. 2, it is understood that these actually represent a plurality of similar harmonic coefficient memories. Using the selected combination of accompaniment harmonic coefficient memories, the accompaniment master data set generator 173 creates an accompaniment master data set which is used by the accompaniment tone generators assigned to keyswitch closures on the accompaniment keyboard.

Figure 3:
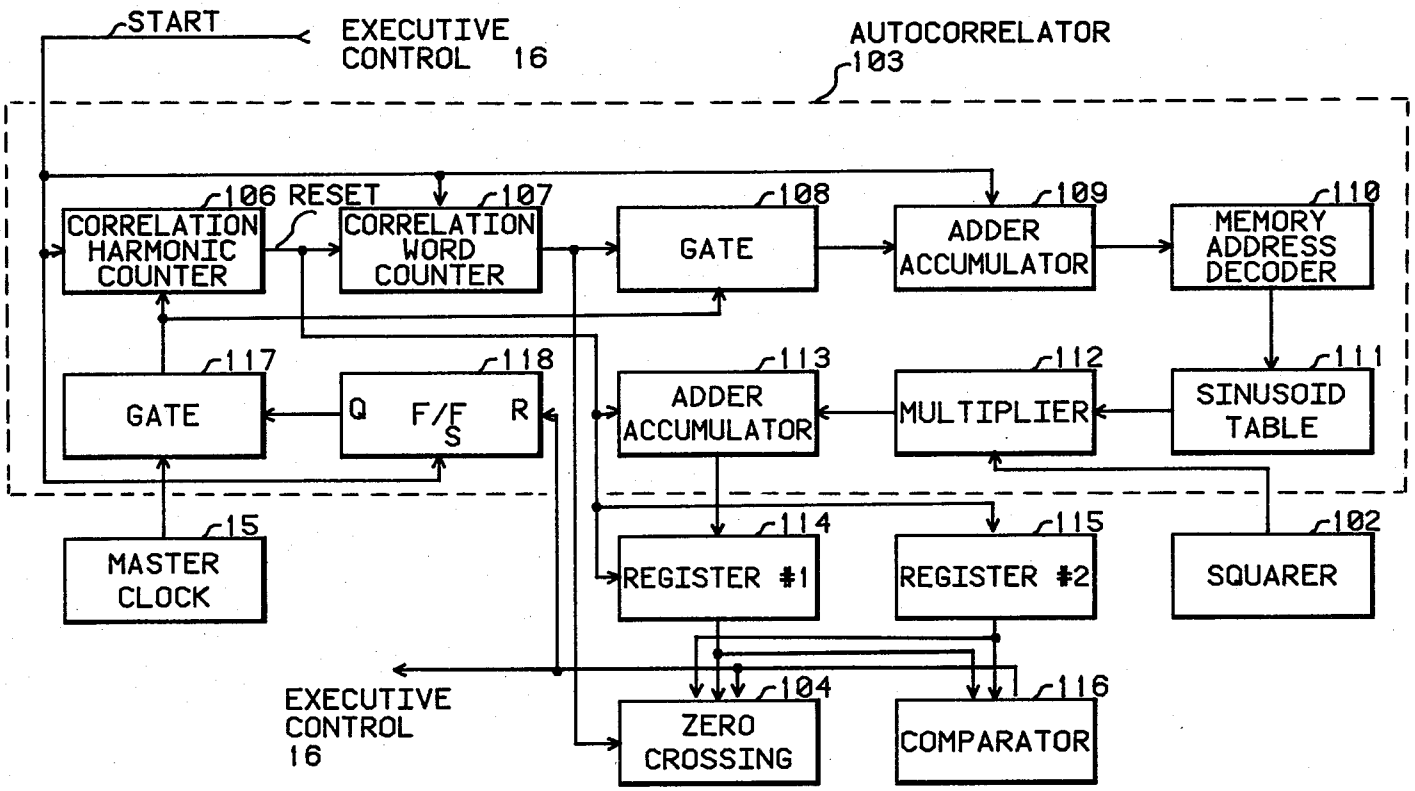
FIG. 3 is a schematic diagram of the autocorrelator.

FIG. 3 illustrates the system logic details for the autocorrelator 103. The autocorrelator elements are contained within the dashed outline. At the start of a computation cycle, a START signal is generated by the executive control 16. The START signal sets the flip-flop 118 and resets the correlation harmonic counter 106 and the correlation word counter 107 to their initial count states.

The autocorrelator 103 is implemented to find the autocorrelation function by computing the discrete Fourier-cosine transform of the square of the harmonic coefficients. It is well-known in the signal processing art that the autocorrelation function is the Fourier-cosine transform of the power density function. In this case, the squared harmonic coefficient values are equivalent to power density function values.

The autocorrelation function is only evaluated for increasing values of the spacing parameter $\tau$ until a spacing is found at which the algebraic sign of the autocorrelation function changes. At this time, an interpolation procedure is implemented by means of the zero crossing 104 to find the position $x_0$ for the first zero crossing of the autocorrelation function.

When the flip-flop 118 is set, the gate 117 transfers timing signals from the master clock 15 to increment the count state of the correlation harmonic counter 106. The correlation harmonic counter 106 is implemented to count modulo 32. This number is selected to be equal to one-half of the number of data points in a master data set which corresponds to one period of a generated waveshape.

Each time that the correlation harmonic counter 106 returns to its initial count state because of its modulo counting implementation, it generates a RESET signal. This RESET signal is used to increment the correlation word counter 107. The correlation word counter 107 can be implemented to count modulo 64, as 64 is the highest theoretical count limit for the autocorrelation function spacing. However, the zero crossing of the autocorrelation function will always occur for a count state note exceeding 17. Thus some economy can be achieved by implementing the correlation word counter to count modulo 17.

Each time that the correlation harmonic counter 106 is incremented, gate 108 transfers the present count state of the correlation word counter 107 to the adder-accumulator 109. The adder-accumulator 109 adds the received data to the value previously accumulated to form an accumulated sum value. The accumulator contained in the adder-accumulator 109 is initialized to a zero value in response to the START signal provided by the executive control 16.

The memory address decoder 110 addresses out stored data values from the sinusoid table 111 in response to the accumulated sum value contained in the adder-accumulator 109. The sinusoid table 111 stores values of the trigonometric function cos ($\pi x/32$). x ranges in value from 0 to 63.

The trigonometric value addressed out from the sinusoid table 111 is multiplied by the current data output from the squarer 102 by means of the multiplier 112. The product value provided by the multiplier 112 is added to the data previously contained in the accumulator in the adder-accumulator 113 to form an accumulated sum value. This product value is called an autocorrelation function component value while the accumulated sum value is an autocorrelation function value.

The adder-accumulator 113 is reset to an initial zero value each time that the correlation word counter 107 is incremented in response to the RESET signal generated by the correlation harmonic counter 106. Before the adder-accumulator 113 is reset by the RESET signal, the content of register 114 is transferred to the register 115 and the content of the adder-accumulator 113 is transferred to the register 114.

The net result the system operation described above is that the register #1 114 contains the autocorrelation function value for the state j of the correlation word counter 107 while the register #2 115 contains the autocorrelation function value corresponding to the state $j-1$ of the correlation word counter 107. The states of the correlation word counter 107 correspond to the displacement variable $\tau$ in Eq. 3.

At some displacement value $x_0$ there will exist a zero crossing of the autocorrelation function. Thus for some count state k, greater than or equal to $x_0$, a positive number or a zero value will be contained in the register #2 115 while a negative number will exist in the register #1 114. The zero crossing displacement variable $x_0$ is not necessarily equal to any integer count state of the correlation word counter 107.

The value of $x_0$ is computed from the count state k and the contents of the registers 114 and 115. The existence of a zero crossing of the autocorrelation function is determined by the comparator 116 while the zero crossing 104 calculates the value of $x_0$ for the correlation spacing parameters corresponding to the first zero crossing of the autocorrelation function.

Figure 4:
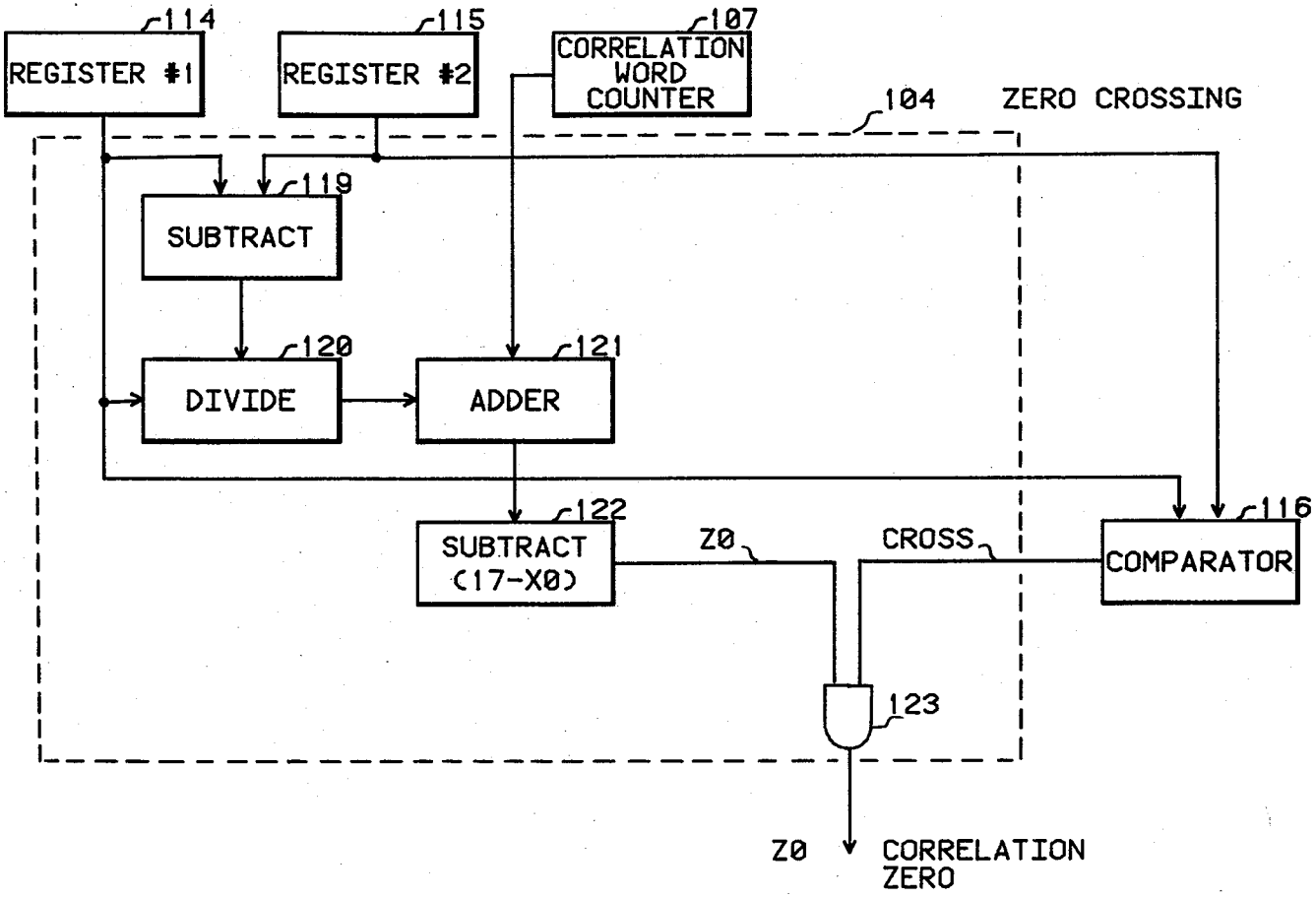
FIG. 4 is a schematic diagram of the zero crossing system block 104.

FIG. 4 illustrates the logic details for the system block labeled zero crossing 104. The subtract 119 provides a register difference value which is the difference of the data values contained in register #1 114 and register #2 115. The register difference value from the output of the subtract 119 is divided by the value contained in register #1 114 by means of the divide 120. The output of the divide 120 is added to the current state of the correlation word counter 107 to yield the value of $x_0$. It is recognized that $x_0$ is calculated by a linear interpolation process based upon the data values contained in registers 114 and 115.

The subtract 122 computes the value of $z_0=17-x_0$. $z_0$ is used as the first zero crossing for selection of the accompaniment tones that will be adaptively chosen to complement the selected solo tones. $z_0$ is called the complementary zero crossing value. The value of $z_0$ is transferred by means of the AND-gate 123 in response to a CROSS signal which is generated by the comparator 116. The CROSS signal is generated by the comparator 116 when register #1 114 has a negative value and register #2 115 has a zero or positive value. The comparator 116 is implemented as a conventional digital value comparator logic circuit. While the AND-gate 123 is shown as a single gate, this is intended as a symbolic representation of a set of AND-gates equal in number to the number of data bits in the binary representation of the numerical value of $z_0$.

The CROSS signal from the comparator 116 is used to reset the flip-flop 118 in FIG. 3 thereby terminating the search for the first zero crossing of the autocorrelation function.

The complementary zero crossing $z_0$ is computed as $z_0=k_0-x_0$. While $k_0$ is a somewhat arbitrary preselected number, it has been found that $k_0=17$ is a good choice.

While in FIG. 2 only two accompaniment harmonic coefficient memories 171 and 172 are shown explicitly, it is understood that these represent a multiplicity of similar harmonic coefficient memories.

Each set of harmonic coefficients stored in one of the harmonic coefficient memories contains a set of 32 harmonic coefficients, a stop (or memory) identification word, a zero crossing value T, and a power value P. The value T corresponds to the first zero crossing of the autocorrelation function corresponding to the waveshape that is generated by the corresponding set of harmonic coefficients. The power value is equal to the average squared value of the waveshape which is the power associated with the waveshape.

Figure 5:
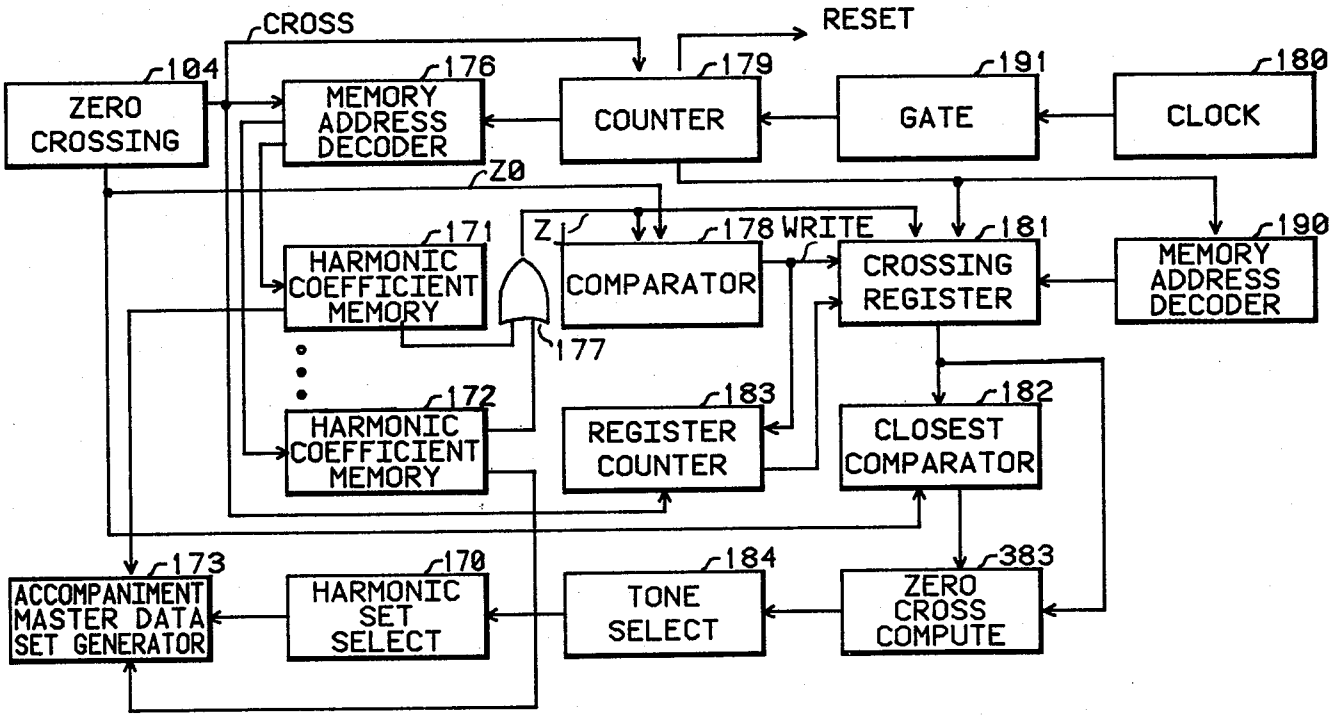
FIG. 5 is a schematic diagram of the harmonic set select 170.

FIG. 5 illustrates a portion of the logic used to implement the harmonic set select 170 shown in FIG. 2.

The counter 179 is initialized by means of the CROSS signal generated by the comparator 116 shown in FIG. 4. The counter 179 is incremented by means of the clock 180. The memory address decoder 176 reads out data stored in the set of harmonic coefficient memories in response to the count state of the counter 179. At this time only the stored zero crossing number, power number, and memory identification number are read out from each harmonic coefficient memory. It is convenient to implement the set of three data values as a single binary number stored in a single memory address. The individual values are readily available by selecting a first, middle, and last set of bits of the single composite digital word.

The comparator 178 compares the zero crossing value $z_0$ with each zero crossing value $z_j$ read out in turn from the set of harmonic coefficient memories 171–172 in response to the memory address decoder 176. A WRITE signal is generated by the comparator 178 if the current value of $z_j$ is less than or equal to the zero crossing value $z_0$.

In response to the WRITE signal, the count state of the counter 179 and the present value of $z_j$ is stored in the crossing register 181 at an address corresponding to the count state of the register counter 183. The register counter 183 is incremented by the WRITE signal from the comparator 178 and is initiated to its initial count state in response to the CROSS signal generated by the zero crossing 104.

When the counter 179 reaches its maximum count state and is then reset to its initial count state because of its modulo counting implementation, a RESET signal is generated. Counter 179 is implemented to count modulo the number of stops associated with the accompaniment keyboard.

The generation of the RESET signal by the counter 179 is used to initiate a selection computation mode during which two accompaniment stops are selected to be used for the accompaniment tone in response to the current selected combination of solo keyboard tones. While the invention is described for a selection of two accompaniment stops this is merely for an illustrative example. It is evident that the described system is readily extended to a selection of a combination of any preselected number of accompaniment stops.

During the selection computation mode, the memory address decoder 190 will cause the data stored in the crossing register 181 to be read out sequentially to the closest comparator 182. The closest comparator 182 selects and stores the zero crossing value $z_j$ stored in the crossing register 181 which has a maximum value. This maximum value is designated as $z_{jmax}$. $z_{jmax}$ will be the maximum zero crossing value for the stored sets of harmonic coefficients that does not exceed the measured complementary zero crossing value of $z_0$ corresponding to the selected solo stops.

A second scan is then made of the zero crossing data stored in the crossing register 181. As each stored value of $z_j$ is read out of the crossing register 181, the zero cross compute 383 computes an effective zero crossing value $z_{jeff}$ from the values of $z_{jmax}$ and $z_j$. A value $z_{jeff}$ is selected which is closest to the measured zero crossing value $z_0$. In response to the selected value of $z_{jeff}$, the tone select 184 then determines the harmonic coefficient memory designations j and k to be used to generate the accompaniment tones. The selected values of j and k are furnished to the tone select 185 which then provides the corresponding harmonic coefficients to the accompaniment master data set generator 173.

Figure 6:
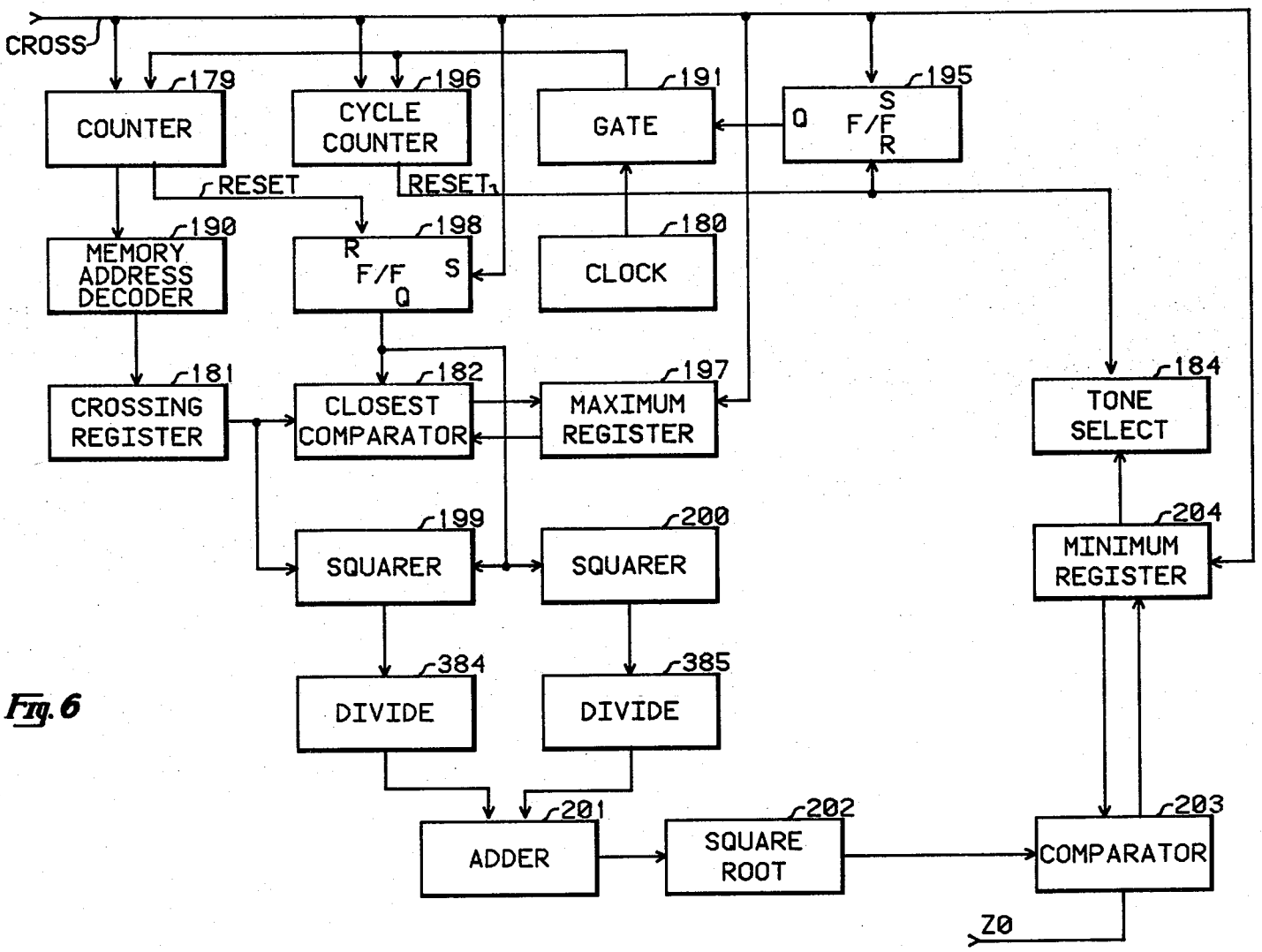
FIG. 6 is a schematic diagram of the accompaniment stop select subsystem.

FIG. 6 illustrates the logic details used to select the accompaniment stops.

The CROSS signal generated by the comparator 116, shown in FIG. 4, is used to set the flip-flop 195 and to reset the counter 179 and the cycle counter 196 to their initial count states. Counter 179 counts modulo the number of data word addresses available in the crossing register 181. This number corresponds to the number of available accompaniment stops and is equivalent to the number of harmonic coefficient memories symbolized by system blocks 171 and 172. Cycle counter 196 counts modulo twice the number of data word addresses available in the crossing register 181. Thus counter 179 will cycle through two complete count sets for one complete count cycle of the cycle counter 196.

The memory address decoder 190 reads out values of the zero crossing $z_j$ stored in the crossing register 181 in response to the states of the counter 179. When flip-flop 195 is set by the CROSS signal, timing signals from the clock 180 are transferred through gate 191 to increment the states of both the counter 179 and the cycle counter 196.

As a stored zero crossing value is read out of the crossing register 181, it is compared with a data value stored in the maximum register 197 by means of the closest comparator 182. A zero data value is stored in the maximum register 197 in response to the CROSS signal. The largest value of either the data value stored in the maximum register 197 or the current value read out of the crossing register 181 is selected by the closest comparator 182 and is then written into the maximum register 197. The net result is that when the counter 179 has been incremented for its first complete counting cycle, the maximum register 197 will contain the value of $z_{jmax}$ which is the maximum value of the stored crossing values in the harmonic coefficient memories that is less than the measured value of $z_0$.

The flip-flop 198 is set in response to the CROSS signal. While flip-flop 198 is set so that its output binary state is Q="1", the closest comparator 182 acts as previously described. When the counter 179 returns to its initial count state because of its modulo counting implementation, it generates a RESET signal. The RESET signal generated by the counter 179 is used to reset the flip-flop 198. In response to the flip-flop 198 binary state Q="0", the closest comparator 182 is inhibited from writing data into the maximum register 197.

While the counter 179 is incremented during its second count cycle, the data now addressed out from the crossing register 181 is squared in magnitude by means of the squarer 199. Only the bits in each data word which represent the zero crossing value are squared. The stop, or harmonic coefficient memory, identification bits are unaltered by the squarer 199. The value of $z_{jmax}$ stored in the maximum register 197 at the end of the first cycle of counter 179, is squared in magnitude by means of the squarer 200. The output from the squarer 199 is divided by the power data word P associated with the zero crossing value accesed from the corresponding harmonic coefficient memory by means of the divide 384. Similarly, the output from the squarer 200 is divided by the associated power data word P by means of the divide 385. The output signals from the divide 384 and the divide 385 are summed in the adder 201 and the square root of the summed value is computed by means of the square root 202.

The comparator 203 subtracts the zero crossing value $x_0$ from the output of the square root 202 to form a crossing test value. This crossing test value is compared with a data value stored in the minimum register. The lesser of these two values is written into the minimum register 204. The crossing test value is also called an effective crossing value. The contents of the minimum register are initialized to the maximum possible value of the number of stored bits (all bits positions are "1") in response to the CROSS signal.

At the end of the second count cycle of the counter 179, the minimum register 204 will contain a data word having an identification number corresponding to a stop j, or equivalently a designator of an harmonic coefficient memory. At the end of the second count cycle, cycle counter 196 generates a RESET signal which is used to reset the flip-flop 195 thereby terminating the zero crossing calculations. In response to the RESET signal generated by the cycle counter 196, the tone select 184 will transfer the stop identification number of the data word stored in the maximum register 197 and the stop identification number of the data word stored in the minimum register 204 to the harmonic set select 170.

It is evident from the preceding system description that the zero crossing for the combination of two tones (stops) has been computed as a weighted RMS value of the two individual zero crossing values. The individual crossing values are weighted by their associated power values. The weighted RMS value is not the theoretically correct manner of combining individual tones to find a resultant zero crossing value. However, experiments conducted with some typical accompaniment tones indicates that the weighted RMS combination algorithm is sufficiently accurate to be used as a component of the selection algorithm to select a combination of tones which complement a selected solo tone.

Figure 7:
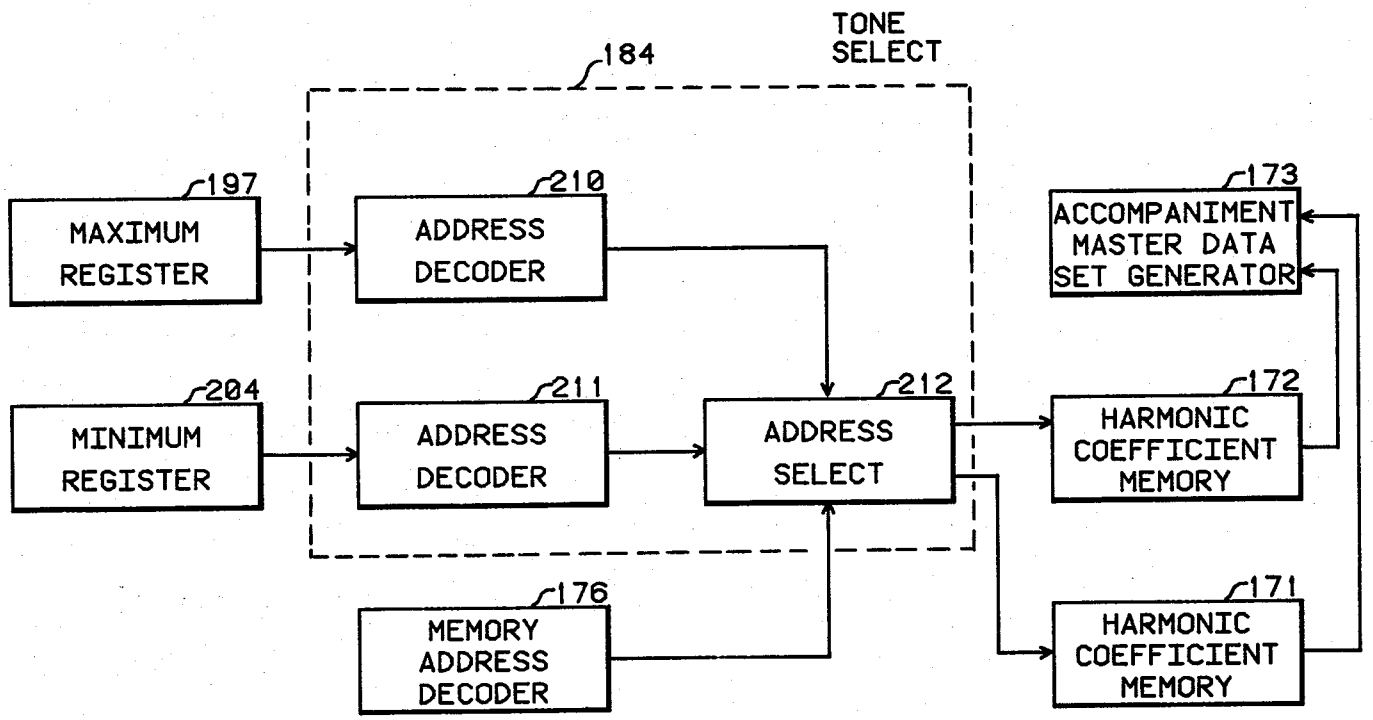
FIG. 7 is a schematic diagram of the tone select 184.

FIG. 7 illustrates the details of the tone select 184. Address decoder 210 selects the tone identification bits from the data word stored in the maximum register 197. The bits correspond to one of the set of harmonic coefficients shown symbolically by the harmonic coefficient memories 171–172. Similarly the address decoder 211 selects the tone identification bits from the data word stored in the minimum register 204. The address select 212 inhibits all the addresses furnished by the memory address decoder from reaching the set of harmonic coefficient memories except for those addresses corresponding to the data furnished by the address decoder 210 and the address decoder 211.

Figure 8:
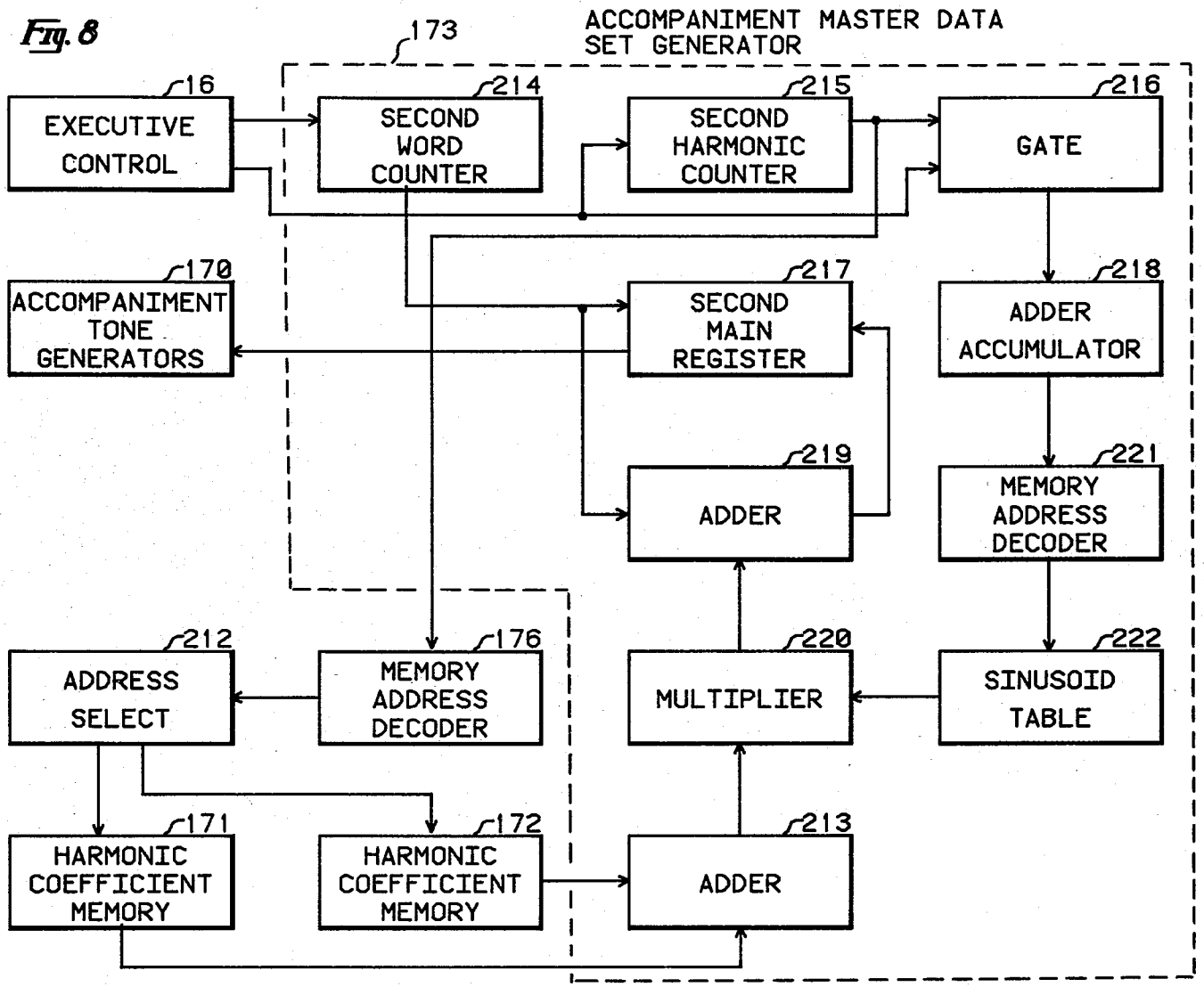
FIG. 8 is a schematic diagram of the accompaniment master data set generator 173.

FIG. 8 shows the details of the accompaniment master data set generator 173. This subsystem operates in a manner analogous to the system elements shown in FIG. 2 which are used to generate the master data used by the solo tone generators 252. This operation is described in the referenced U.S. Pat. No. 4,085,644. The equivalent subsystem blocks are the pairs 19–214, 20–215, 21–216, 23–221, 24–222, 28–220, 33–219, 34–219, 25–176, 26–171, 27–172. The accompaniment master data set is computed and stored in the second main register 217. This master data set is transferred to memories located within the set of accompaniment tone generators 170 and converted into musical tones in the manner described in the referenced U.S. Pat. No. 4,085,644.

Figure 9:
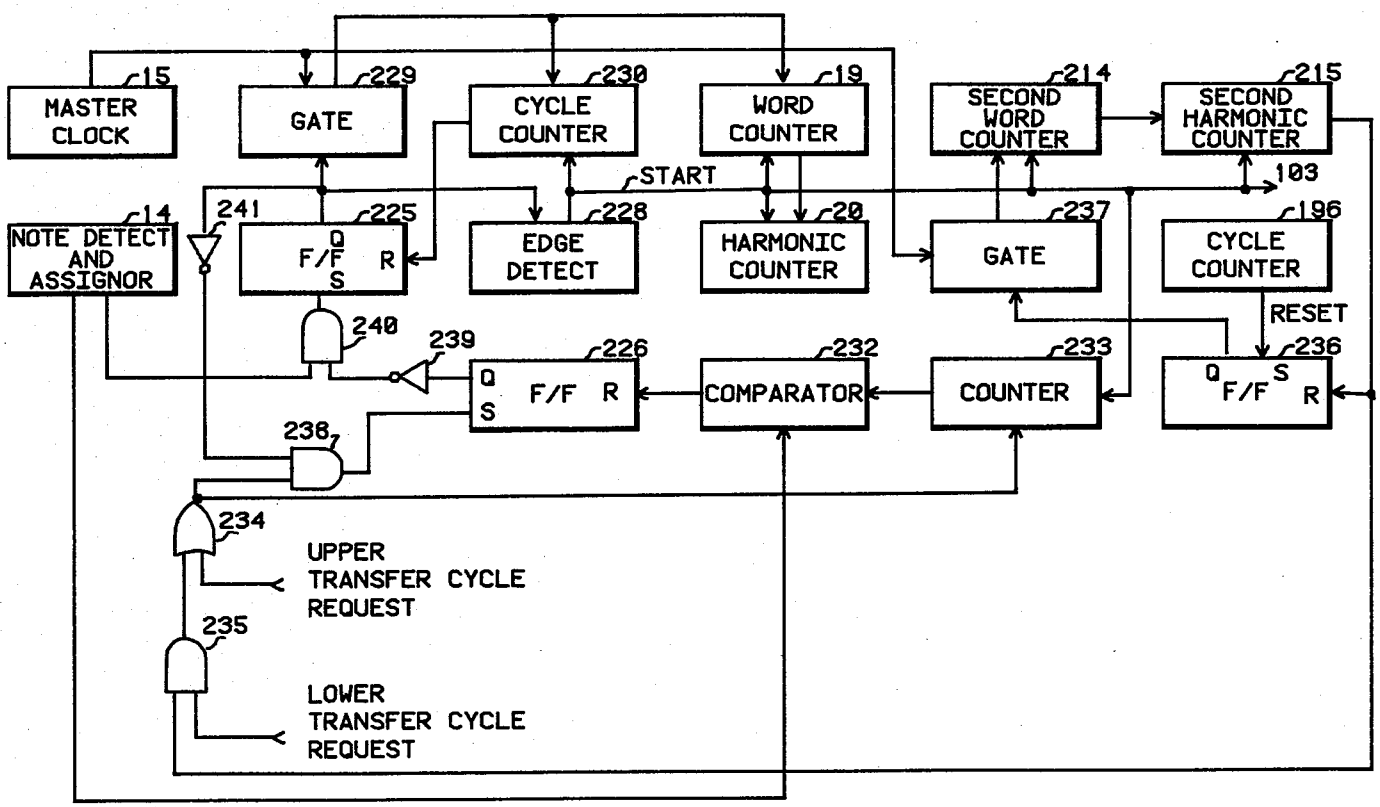
FIG. 9 is a schematic diagram of the executive control 16.

FIG. 9 shows an implementation for the system elements of the executive control 16. A complete computation cycle is initiated when flip-flop 225 is set so that its output logic state is Q="1". Flip-flop 225 can be set in response to a signal from the note detect and assignor 14 if flip-flop 226 has its output in a state Q="0". As described below, flip-flop 226 is used to control the start of a computation cycle. It is desirable that a new computation cycle not be initiated until the transfer cycle has been completed. Note detect and assignor 14 will generate a request for the start of a computation cycle if this subsystem has detected that a keyswitch has been actuated on the musical instrument's keyboard. An alternative logic is to always initiate a complete computation cycle when a transfer cycle is not in progress, or to initiate a computation cycle at the completion of each transfer of a master data set to one of the assigned tone generators.

When flip-flop 225 is set at the start of a computation cycle, the output binary logic state Q="1" is converted into a signal pulse, labeled START by means of the edge detect circuit 228. As described in the referenced U.S. Pat. No. 4,085,644 the START signal is used to initialize the word counter 19 and the harmonic counter 20. The START signal is also provided to the autocorrelator 103.

The logic state Q="1" from the flip-flop 225 causes gate 229 to transfer timing signals from the master clock 15 which increments the cycle counter 230 and the word counter 19.

For the first portion of the computation cycle during which a master data set is computed for the solo tone generators assigned to the upper, or solo keyboard, cycle counter 230 counts a total of $64\times32=2048$ master clock timing signals. This number is equal to the product of the number of data words in a master data set multiplied by the maximum number of harmonic coefficients used to construct a selected musical tone. When the cycle counter 230 reaches its maximum count state, a signal is generated which resets the flip-flop 225.

The word counter 19 is implemented to count modulo 64 which is equal to the number of data words in a master data set. Each time that the word counter 19 returns to its initial state, because of its modulo counting implementation, a RESET signal is generated. This RESET signal is supplied to increment the count state of the harmonic counter 20.

A number equal to the total number of assigned solo and accompaniment tone generators is transmitted to the comparator 232 from the note detect and assignor 14. Counter 233 is incremented by the transfer cycle requests that appear at the output of the OR-gate 234. The transfer cycle requests for the assigned accompaniment tone generators, labeled as lower transfer cycle requests, are inhibited from incrementing the counter 233 until the second harmonic counter 215 has been incremented to its maximum count state at which time an accompaniment master data set has been computed to be used by the assigned accompaniment tone generators. AND-gate 235 accomplishes the function of inhibiting the lower transfer cycle requests until the accompaniment master data set has been computed. Counter 233 is reset to an initial count state at the start of a computation cycle by means of the signal produced by the edge detect 228.

The RESET signal generated by the cycle counter 196 is used to set the flip-flop 236. When this flip-flop is set, gate 237 will transfer timing signals from the master clock 15 which will increment the second word counter 214. Each time that the second word counter 214 returns to its initial count state because of its modulo counting implementation a signal is set to increment the count state of the second harmonic counter 215. Both the second word counter 214 and the second harmonic counter 215 are reset to an initial count state in response to the START signal created by the edge detect 228.

When the comparator 232 finds that the counter 233 has been incremented to a count state equal to the total number of assigned tone generators, a signal is generated which resets the flip-flop 226. When flip-flop 226 is reset, a new computation cycle can again be initiated.

A variety of modifications are readily implemented for the described invention. Instead of computing the zero of the accompaniment autocorrelation function as $17-x_0$, other expressions can be used such as $z_0=k-f(x_0)$ where k is a specified constant and $f(x_0)$ is a function of the zero crossing value $x_0$. For example the expression $z_0=K-A\ \exp(BxO)$ provides a useful output for various selected values of the constant K, A, B.

While the invention was described for the selection of a combination of two accompaniment tones, this was merely for illustrative purposes. The previously described system is readily extended to any desired number of stops. This is done by extending the computation of an effective weighted RMS value of the zero crossings to include the desired number of stops to be selected to produce a combination accompaniment tone.

It is evident that the invention is not limited to systems which synthesize an accompaniment musical waveshape from a stored set of harmonic coefficient values. The same accompaniment tone selection can be implemented for a system in which a zero crossing value and power number are stored for each accompaniment stop, or tone, switch.

I claim:

1. In a musical instrument having a number of tone generators, in which a plurality of data words corresponding to the amplitudes of points defining the waveform of a musical tone are computed and transferred sequentially to a digital-to-analog converter to be converted into audible musical tones, apparatus for selecting a combination of accompaniment musical tones from a library of accompaniment musical tones which complement a selected solo musical tone comprising:

a coefficient memory for storing a set of solo harmonic coefficient values, a first means for computing a solo master data set comprising a plurality of data points defining the waveform of a solo musical tone from said stored set of solo harmonic coefficient values, a solo means for producing a solo musical tone from said solo master data set, a second means for computing responsive to said stored set of solo harmonic coefficient values whereby a set of autocorrelation function data values are computed, a plurality of accompaniment harmonic coefficient memories each storing a set of accompaniment harmonic coefficient values and a zero crossing value, an accompaniment addressing means for accessing a set of accompaniment harmonic coefficient values and a zero crossing value from each of said plurality of accompaniment harmonic coefficient memories, a tone selection means responsive to said set of autocorrelation values and each said zero crossing value accessed by said accompaniment addressing means whereby a multiplicity of selection numbers are generated, a third means of computing responsive to accompaniment harmonic coefficient values accessed from said plurality of accompaniment harmonic coefficient memories whereby an accompaniment master data set comprising a plurality of data points defining an accompaniment musical tone is computed, an harmonic selection means interposed between said plurality of accompaniment coefficient memories and said third means for computing whereby selected accompaniment harmonic coefficient values accessed by said accompaniment addressing means are transferred to said third means for computing in response to said multiplicity of selection numbers, and an accompaniment means responsive to said accompaniment master data set whereby said combination of accompaniment musical tones are produced which complement said solo musical tone.

2. A musical instrument according to claim 1 wherein said second means for computing comprises:

a squarer means, responsive to said solo harmonic coefficient values read out from said coefficient memory whereby each of said solo harmonic coefficient values is multiplied by itself thereby producing a power coefficient value, a clock means for providing timing signals, a first counter means for counting said timing signals modulo a first specified number and wherein a first reset signal is generated when said first counter means returns to its initial count state, a second counter means incremented by said first reset signal wherein said second counter means counts modulo a second specified number, a first adder-accumulator means for successively adding the contents of said second counter means to a sum value contained in said first adder-accumulator means, a sinusoid table for storing a set of trigonometric function values, a first addressing means whereby a trigonometric function value is read out of said sinusoid table in response to the sum value contained in said first adder-accumulator means, a first multiplier means for multiplying the trigonometric function value read out from said sinusoid table by said power coefficient value to create an autocorrelation function component value, a means for accumulating each said autocorrelation function value thereby generating a sequence of autocorrelation function values, and a zero crossing means, responsive to said sequence of autocorrelation function values, wherein a zero crossing signal is generated when one of said sequence of autocorrelation function values has a positive numerical value and is followed in sequence by one of said sequence of autocorrelation function values which has a negative or zero numerical value.

3. In a musical instrument according to claim 2 wherein said zero crossing means comprises:

an interpolation means whereby a solo zero crossing value is computed from said sequence of autocorrelation function values in response to said zero crossing signal, and a complementary generator means whereby a complementary zero crossing value is generated in response to said solo zero crossing value.

4. In a musical instrument according to claim 3 wherein said interpolation means comprises:

a first register means for storing one of said sequence of autocorrelation function values, a second register means for storing an autocorrelation function value, a transferring means for transferring an autocorrelation function value from said first register means to said second register means, a subtracting means wherein a difference value is generated by subtracting the contents of said second register means from the contents of said first memory means, a divider means for driving said difference value by the content of said first register means to form a correction value, and an interpolation adder for adding the said correction value and the count state of said first counter means to form said zero crossing value in response to said zero crossing signal.

5. In a musical instrument according to claim 3 wherein said tone selection means comprises:

a multiplicity of crossing storage means, a first comparison means whereby each said zero crossing value accessed from said plurality of accompaniment harmonic coefficient memories is furnished to one of said multiplicity of crossing storage means if said zero crossing value is not larger than said complementary zero crossing value, a second comparison means for selecting the maximum crossing value of all zero crossing values stored in said multiplicity of crossing storage means, an effective crossing computation means wherein effective crossing values are computed for said select maximum crossing value and each zero crossing value stored in said multiplicity of crossing storage means, a third comparison means for selecting the minimum value of said effective crossing values which is less in value than said complementary zero crossing value, and a tone encoding means wherein a first selection number is generated corresponding to one of said plurality of accompaniment harmonic coefficient memories from which said maximum crossing value is accessed and wherein a second selection number is generated corresponding to one of said plurality of accompaniment harmonic coefficient memories from which a zero crossing value is accessed corresponding to the minimal value selected by said third comparison means.

6. In a musical instrument according to claim 5 wherein said effective crossing computation means comprises:

a first squaring means wherein said maximum crossing value is multiplied by itself to create a squared maximum crossing value, a second squaring means wherein each said zero crossing value stored in said multiplicity of crossing storage means is multiplied by itself to create a corresponding squared crossing value, an adder means for forming a sum value for said squared maximum crossing value added to said squared crossing value, and a square root means for evaluating the square root value of said sum value thereby generating said effective crossing value.

7. In a musical instrument having a number of keyboards comprising a plurality of keyswitches and having a number of tone generators, in which a plurality of data points defining the waveform of a musical tone are computed and transferred sequentially to a digital-to-analog converter to be converted into audible musical tones, apparatus for selecting a combination of accompaniment musical tones from a library of accompaniment musical tones which complement a selected solo musical tone comprising:

a solo coefficient memory for storing a plurality of sets of solo harmonic coefficient values, a plurality of solo tone switches wherein each setting of the tone switches corresponds to a selection of a predetermined musical tone, a first addressing means responsive to the setting of said plurality of tone switches for reading out a corresponding set of solo harmonic coefficient values from said coefficient memory, a solo computing means responsive to said selected set of solo harmonic coefficient values for generating and storing a solo master data set having data values corresponding to a succession of points for said selection of a predetermined solo musical tone, an autocorrelation computing means wherein a set of autocorrelation function values are computed in response to said selected set of solo harmonic coefficient values read out from said solo coefficient memory, a zero crossing memory for storing a plurality of zero crossing values, a plurality of accompaniment tone switches wherein each setting of the accompaniment tone switches corresponds to a selection of a predetermined accompaniment musical tone, a second addressing means for reading out zero crossing values stored in said zero crossing memory, a tone selection means responsive to said set of autocorrelation function values and said read out zero crossing values whereby a multiplicity of selection numbers are generated, a tone setting means reponsive to said multiplicity of selection numbers whereby corresponding ones of said plurality of accompaniment tone switches are set, a solo tone generation means for generating said predetermined solo musical tone from said stored solo master data set, and an accompaniment tone generation means responsive to said setting of accompaniment tone switches whereby an accompaniment musical tone is generated which complements said predetermined solo musical tone.

8. A musical instrument according to claim 7 wherein said autocorrelation computing means comprises:

interpolation means whereby a zero crossing correlation spacing number is computed from each said set of autocorrelation values corresponding to an algebraic sign change between consecutive ones of said set of autocorrelation function values, and a crossing computing means responsive to said zero crossing correlation spacing number wherein a complementary zero crossing number is computed.

9. In a musical instrument according to claim 8 wherein said tone selection means comprises:

a maximum number selection means whereby the largest of said plurality of zero crossing values which is less in magnitude than said complementary zero crossing number is selected, a first encoding means whereby a first selection number is generated corresponding to the zero crossing value selected by said maximum number selection means, an effective crossing computation means whereby a set of effective zero crossing numbers are generated in response to the zero crossing value selected by said maximum number selection means and each zero crossing value read out of said zero crossing memory, and a second encoding means whereby a second selection number is generated corresponding to the maximum one of said effective zero crossing numbers which is less than the value of said complementary zero crossing number.

* * * * *

UNITED STATES PATENT AND TRADEMARK OFFICE

CERTIFICATE OF CORRECTION

PATENT NO. : 4,398,442

DATED : August 16,1983

INVENTOR(S) : Ralph Deutsch

It is certified that error appears in the above-identified patent and that said Letters Patent are hereby corrected as shown below:

Column 3, line 42 change "reference" to --referenced--.

Column 14, line 64 change "driving" to --dividing--.

Signed and Sealed this

*Eighteenth* Day of *October 1983*

[SEAL]

*Attest:*

GERALD J. MOSSINGHOFF

*Attesting Officer*

*Commissioner of Patents and Trademarks*